US007217345B2

(12) United States Patent
Casanova

(10) Patent No.: US 7,217,345 B2
(45) Date of Patent: May 15, 2007

(54) CATHODE GUIDANCE AND PERIMETER DEPOSITION CONTROL ASSEMBLY IN ELECTRO-METALLURGY CATHODES

(75) Inventor: Manuel Rafael Umana Casanova, Santiago (CL)

(73) Assignee: New Tech Copper S.A., Macul, Santiago (CL)

( * ) Notice: Subject to any disclaimer, the term of this patent is extended or adjusted under 35 U.S.C. 154(b) by 184 days.

(21) Appl. No.: 11/128,043

(22) Filed: May 12, 2005

(65) Prior Publication Data

US 2005/0263392 A1 Dec. 1, 2005

(30) Foreign Application Priority Data

May 12, 2004 (CL) ..... 1020-2004

(51) Int. Cl.
*C25D 17/08* (2006.01)

(52) U.S. Cl. ..... 204/224 R; 204/230.2; 204/279; 204/281; 118/624

(58) Field of Classification Search ..... 204/224 R, 204/230.2, 279, 281; 118/624
See application file for complete search history.

*Primary Examiner*—Bruce F. Bell
(74) *Attorney, Agent, or Firm*—Wood, Herron & Evans, L.L.P.

(57) ABSTRACT

Production of pure metals through electro-winning and electro-deposition is accomplished by electrolytic deposition of metal over a reusable stainless-steel plate (cathode). Metal is deposited on both faces of the cathode, as well as on its edges, creating problems when removing the deposited metal. Breaking the deposited edges to remove the metal deposited on both faces produces irregular edges, folding and damages to the surface of the cathode, requiring reprocessing, increasing costs of the deposited metal, as well as repairs or replacement of the cathodes. This invention includes a structure made of insulating material to which are fixed electrically energizable cathode guidance profiles with a cross-section similar to an omega and which house the edges of the cathodes, holding them in position during the process.

7 Claims, 4 Drawing Sheets

CATHODE GUIDANCE AND PERIMETER DEPOSITION CONTROL ASSEMBLY IN ELECTRO-METALLURGY CATHODES

DESCRIPTION OF THE FIELD

The industrial obtaining of high-grade metals such as copper, nickel, zinc and others is realized primarily by electro-deposition of solutions of the respective metals. Whether the metal is obtained from mineral rich solutions using non-soluble anodes or dissolving anodes of the same metal, the cathodes used industrially today are in both cases preferably of stainless steel.

Substantially the same process is also used in the treatment of liquid industrial residues to lower their cathion levels until they are below accepted limits and then discard them, as well as in galvano-plasty, whether to protect metals from corrosion or to deposit metals for purely decorative purposes.

Although the use of stainless steel in the cathodes has resolved other kinds of difficulties, problems have arisen in connection with the removal of the metal deposited in the cathodes, given that the metal is also deposited on the vertical and lower horizontal faces of the same.

The depositions on the cathode are removed mechanically by inserting blades between the metal deposited and the stainless steel plate, method that frequently originates difficulties in the separation that manifest themselves in the irregularities in the borders and scraping and deformities in the faces of the cathodes themselves, which make it necessary to straighten them out, polish them and occasionally, replace the stainless steel cathodes with the associated costs that this involves.

Trying to prevent the deposition of metal on the edges of the cathodes, plastic excluders have been placed on the edges to prevent them from coming into contact with the electrolyte. Although the excluded are pressure-fitted over the edges of the cathodes, the fact that the electrolysis takes place at temperatures of around fifty degrees Celsius causes the excluder to dilate and loose shape. These deformations cause the protection of the edges of the cathode to be imperfect, exposing these zones to contact with the electrolyte and the metal deposition, introducing an additional difficulty to the removal of the excluders and the metal deposited. This is specifically valid in the lower ends of the excluders, which in this case requires that it is removed by striking the excluder with an instrument, which sometimes breaks the excluder and necessitates its replacement, with the costs that such replacement involves.

Another attempt has involved coating the submerged faces of the electrolyte with a semi-frame of the same metal that is being obtained, so as to form a screen that prevents the deposition on the edges. Although this screen does diminish the quantity deposited, it does not entirely resolve the problem. Trying to resolve this weakness, the semi-frame has been connected to an external source of radio frequency, which would resolve the problems. However, the fact that the semi-frame is metallic and connected to the same potential than the cathode causes the metal to deposit over the semi-frame also, thickening it. This makes it necessary to re-condition or replace the semi-frame after a certain number of productive cycles.

Additionally to the problems mentioned, given that the anodes and cathodes are suspended over the vat and that the electrolyte must flow between them, the oscillation of the anodes and cathodes as a result of the flow of the mineral rich solutions occasionally causes some short-circuiting, which makes it necessary to stop the operation, detect their location and eliminate them, with the resulting losses in production and reprocessing of the damaged products, and the repair or replacement of the anodes and cathodes that can be used again.

All these problems increase production costs and cause the loss of premiums or, also, have a negative impact on the price of the product due to the poor quality cathodes being produced.

The numbers indicating the various details of the different Drawings have the following meaning:

1. Body of the Energizable Cathode Guide Profile, built of insulating material, whose cross-section is similar to an Omega and whose separation on opposite ends is slightly larger than the initial thickness of a stainless steel cathode.
2. Mono or Multi-strand electrical conductor inserted into the body of the profile running along one side all the way down and returning to the top end on the opposite side.
3. A second mono or multi strand electrical conductor inserted into the body of the profile, running along one side all the way down and returning to the top end on the opposite side.
4. Stainless steel plate of the initial cathode, over whose surface the metal to be recovered or purified is deposited.
5. Cathode-supporting bar one of whose ends is supported by the power distribution bar of the electrolytic vat.
6. Lower lengthwise supporting frame for the cathode guidance and perimeter deposition control Assembly in electro-metallurgy cathodes.
7. Lower transversal support frame for the cathode guidance and perimeter deposition control Assembly in electro-metallurgy cathodes.
8. Upper transversal support frame for the cathode guidance and perimeter deposition control Assembly in electro-metallurgy cathodes.
9. Upper left hand lengthwise supporting frame for the cathode guidance and perimeter deposition control Assembly in electro-metallurgy cathodes.
10. Upper right hand lengthwise supporting frame for the cathode guidance and perimeter deposition control Assembly in electro-metallurgy cathodes.
11. Lower anode supporting profile (non-energizable)
12. Diagonal structural support profile.

Figure 1:
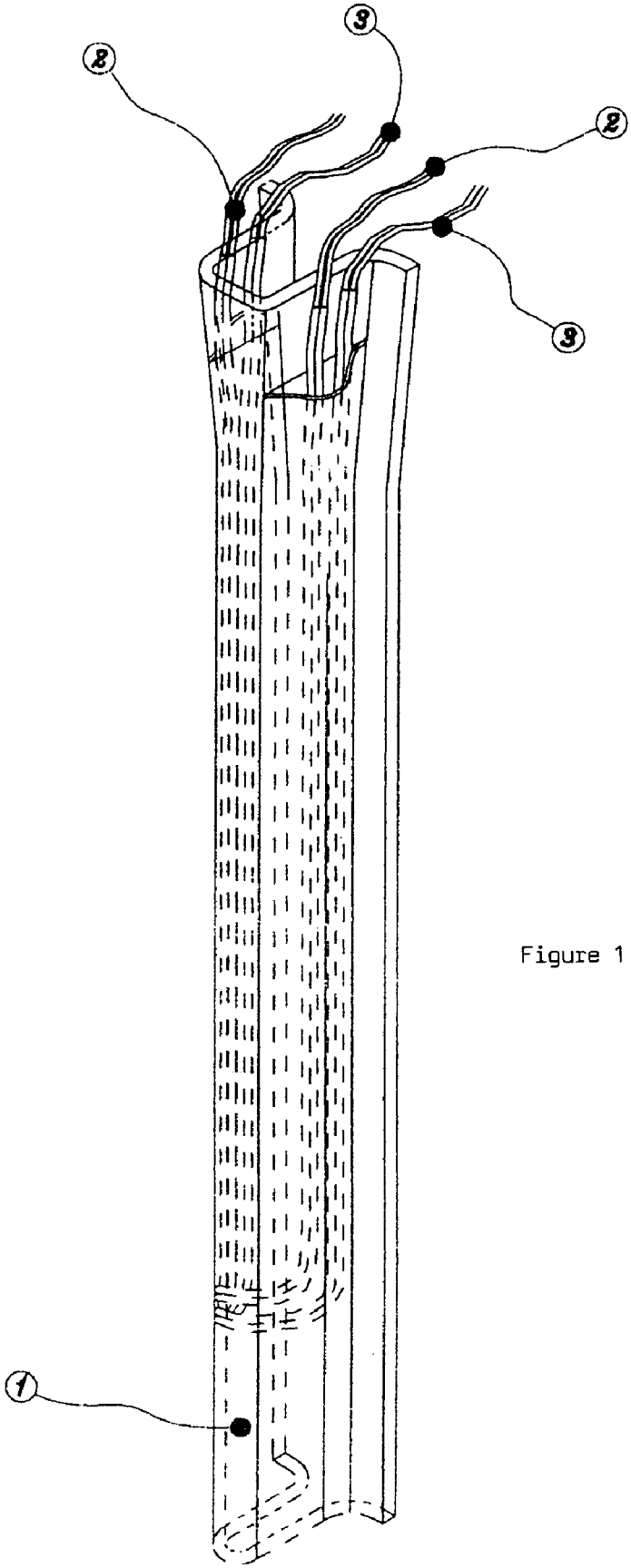
FIG. 1 shows an isometric of the Energizable Cathode Guide Profile.
Figure 2:
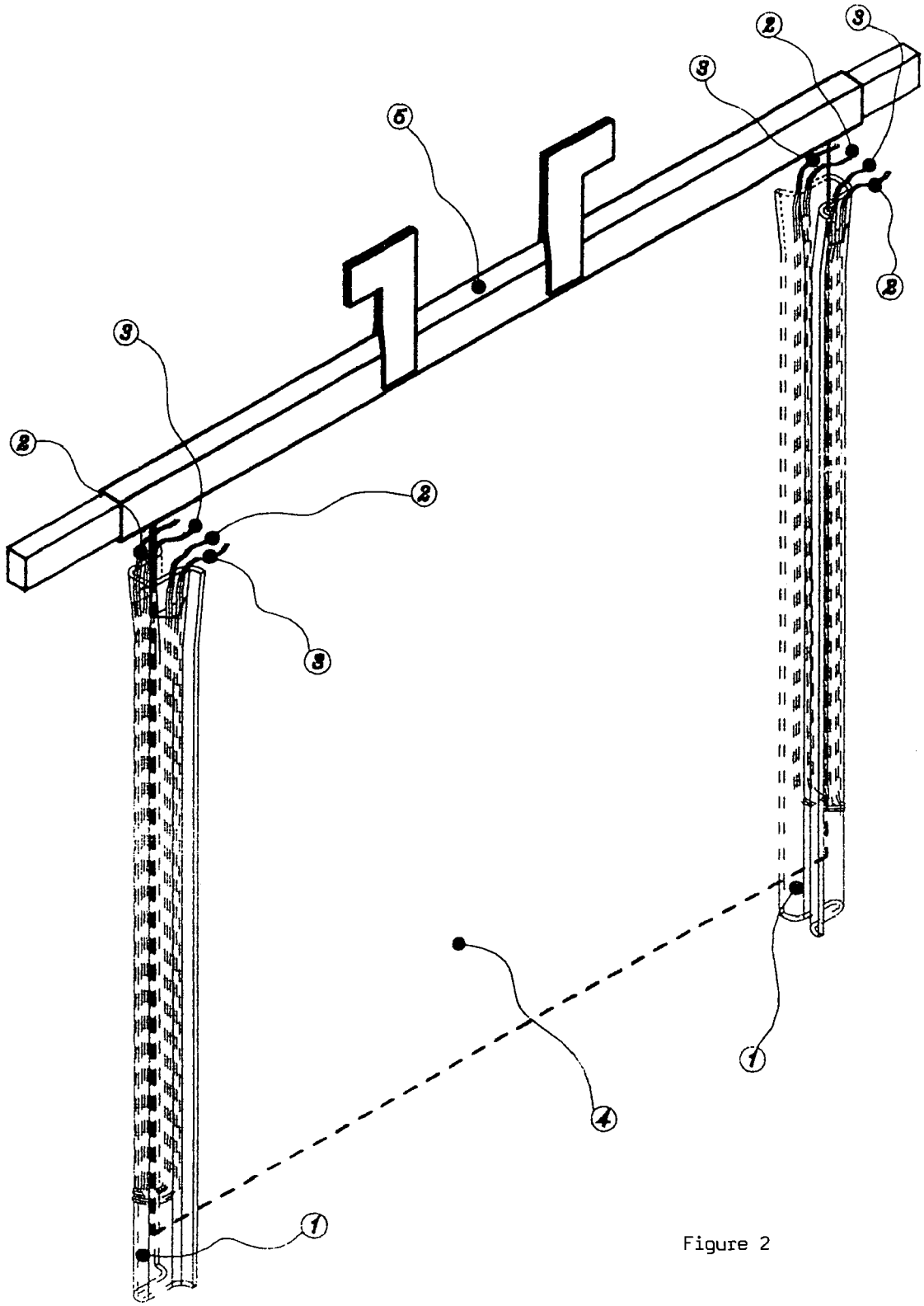
FIG. 2 shows an isometric of a Cathode inserted into Energizable Profiles on both sides.
Figure 3:
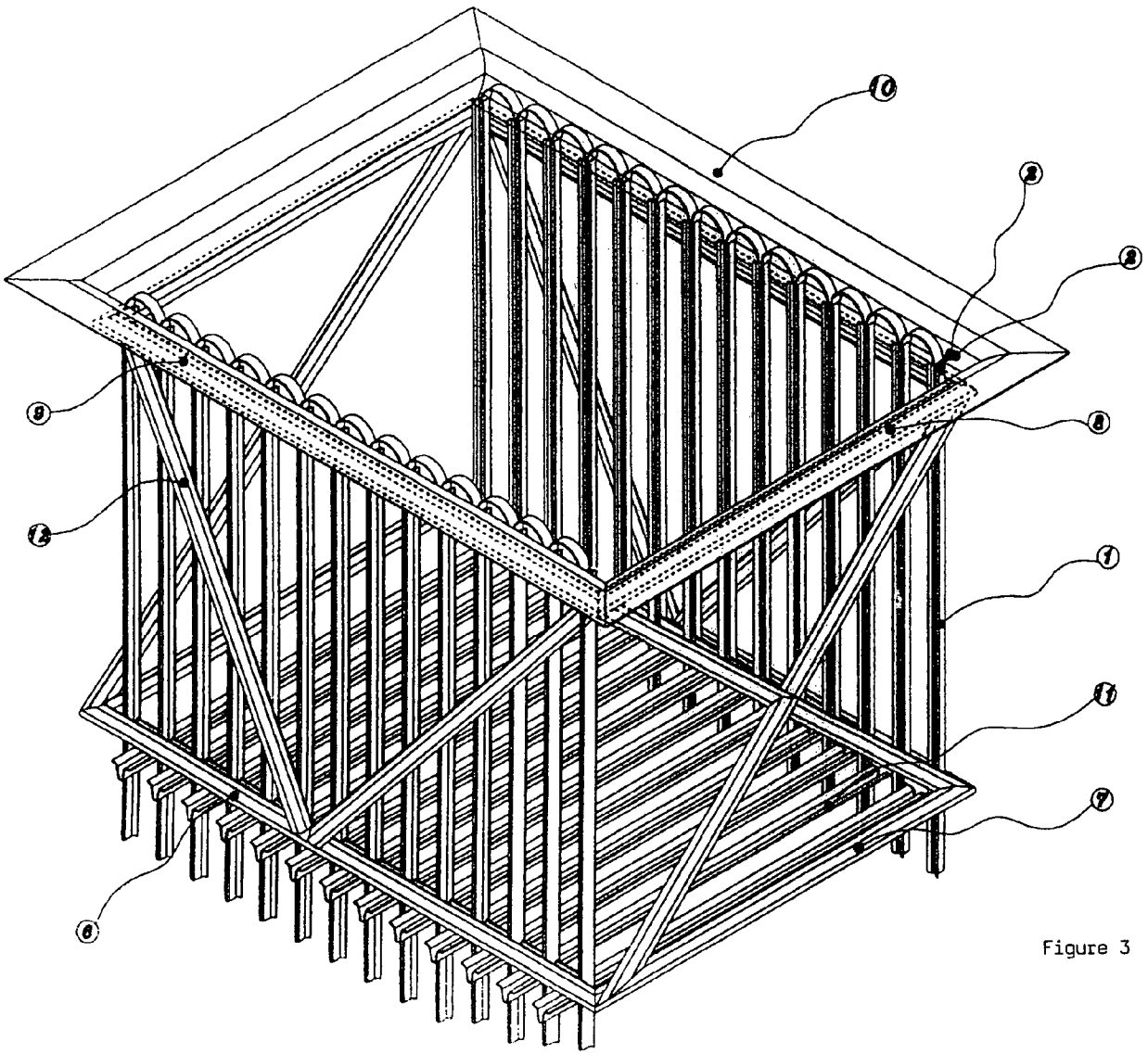
FIG. 3 shows an isometric of the Cathode Guide and Perirmeter Deposition Control Assembly in electro-metallurgy cathodes.

Description of the Cathode Guidance and Perimeter Deposition Control Assembly in Electro-Merallurgy Cathodes The cathode guidance and perimeter deposition control Assembly in electro-metallurgy cathodes consists of a supporting structure, formed by structural profiles such as those indicated by numerals 6, 7, 8, 9, 10 and 12 of FIG. 3, a set of energizable cathode guidance profiles such as those indicated in number 1 of FIG. 1; a set of anode supporting profiles such as the one indicated in number 11 of FIG. 3 and a source of electric power that provides a single direction electrical pulse of an adjustable frequency, which is not shown.

The structural support profiles are arranged on a low horizontal frame formed by profiles 6, 7 and another two symmetrical to these and which are shown in FIG. 3, in an upper horizontal frame formed by profiles 8, 9, 10 and another symmetric to profile 8, shown in FIG. 3 and diagonal profiles such as the one assigned number 12 and others in FIG. 3, which maintain the distance of separation between the upper and lower horizontal frames. The purpose of this structure is to support the vertical positioning of the energizable cathode guidance profiles 1, as well as the horizontal positioning of the anode supporting profiles 11. This structure must be built of insulating materials or be completely coated with insulating material.

The energizable cathode guidance 1, consists of a straight profile of a length greater than that of the cathodes on which they will be used, with a cross section that permits to slip in through one side a cathode, for example, of a similar section to an omega, made of insulating material, resistant to the action of the electrolyte and temperature, into which have been inserted the conductors 2 and 3 of FIG. 1 which in turn are insulated from each other, and come down one side and go up the other and whose ends emerge in both upper ends of the profile. The conductors inserted into the profile may be one or more. These cathode guidance profiles are supported in a vertical position and are rigidly fixed to the supporting structure on both longitudinal sides throughout their surface, symmetrically facing each other and separated at an equal distance from each other, at the same distance in which the cathodes are placed in the Production plant that will use the cathode guidance and perimeter deposition control in electro-metallurgy cathodes Assembly. If required, a horizontal profile may be added to join two opposing vertical profiles, forming a semi-frame to control the deposition on the lower end of the cathodes. Additionally, in order to expedite the removal of the cathodes from the vat, the energizable cathode guidance profiles may be erected in a slightly inclined angle with respect to the vertical, within the plane defined by the cathode, and tilting away from them on the upper side.

The anode supporting profiles 11 are supported horizontally and rigidly fixed to profile 6 and their equivalent in the opposite side of the structure in all of its length and at an equal distance and in the same position in which the anodes are placed in the Production Plant that will use the cathode guidance Assembly and perimeter deposition control in electro-metallurgy cathode The source of electric power may be a generator or electrical converter that is capable of supplying power of around 50 watts per cathode used. The electricity from the power source must be a single direction or single direction pulse and preferably of an adjustable frequency. This due to the fact that before the industrial application the values to be used must be determined case by case, depending on the electrolyte and on operational variables that vary according to each industrial operation. The circulation of this single direction or single direction pulse through the single or multi-thread conductors inserted into the cathode guidance profiles generate an electromagnetic field along the edge of the cathode of such a magnitude and direction that it deviates or repels the trajectory of the cations, preventing them from depositing on the edge of the cathode. One way of generating a single direction signal is by means of the complete or incomplete rectification of an alternate current.

During the attachment of the energizable cathode guidance profiles to the supporting structure, the electrical conductors inserted into them must be connected as, given the corrosive environment that they are in, they must be insulated and protected. In the case shown in FIG. 3, the conductors were connected in a series and protected with insulating material, with the joints adopting the form of semi-circular arches that can be seen all along the upper horizontal support profiles 9 and 10.

EXAMPLE OF APPLICATION

Figure 4:
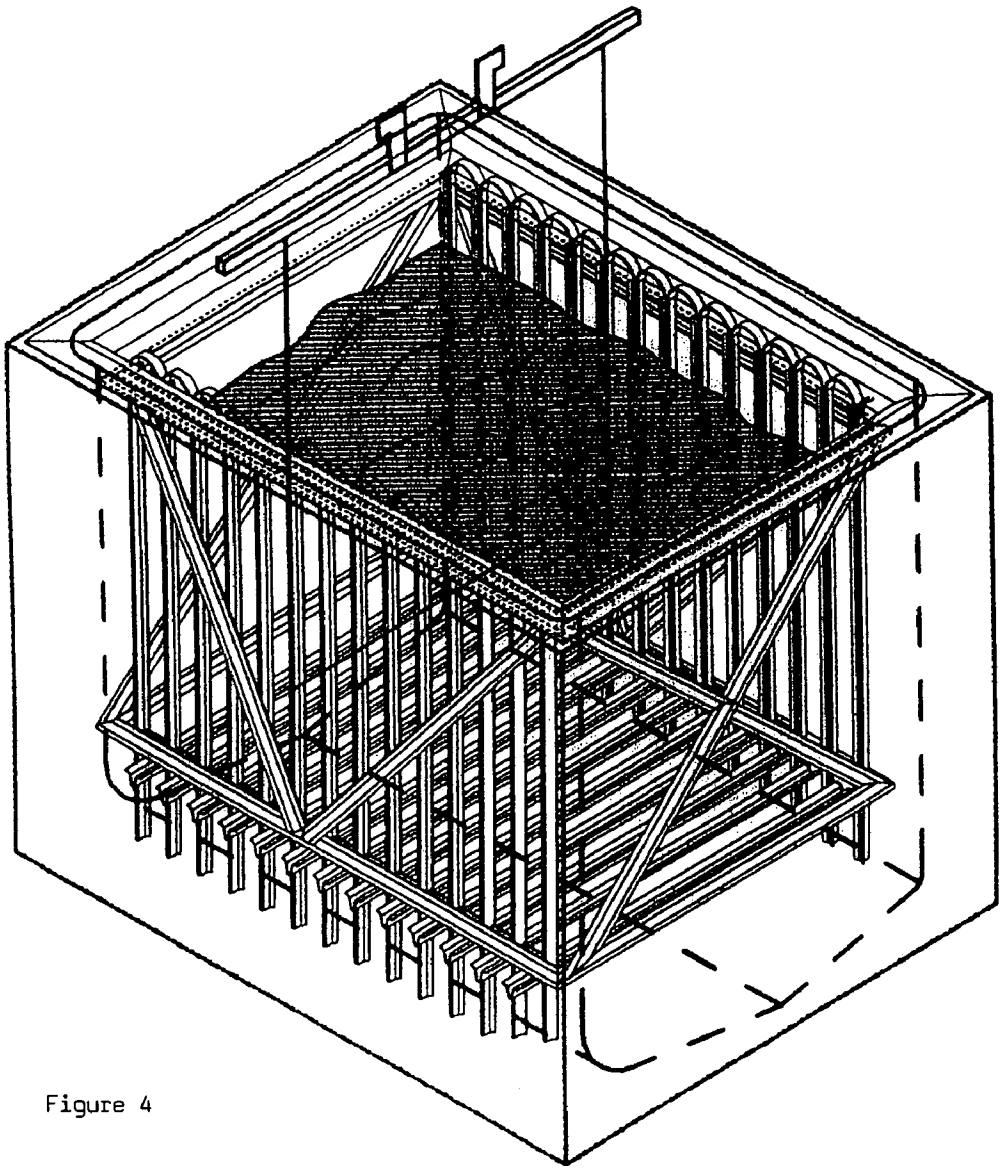
FIG. 4 shows an isometric of the Cathode Guide and Perirmeter Deposition Control Assembly in electro-metallurgy cathodes already immersed in the electrolytic vat during the insertion of single Cathode.

In order to verify experimentally the results of the application of the cathode guidance assembly for electro-metallurgy, the following experiment was carried out in a workshop, simulating the conditions of an industrial plant for the obtaining of copper:

A total of 14 pairs of energizable cathode guidance profiles were immersed in a cement vat and erected in a structure similar to the one shown in FIG. 3. The separation between energizable cathode guidance profiles was equivalent to the energy used in the industrial plant, approximately 100 mm of separation between then, connecting their free ends 2 to the source of the single-direction electric pulse. Thirteen (13) anode supporting frames frames were placed on the lower frame of the structure with the same distance of separation there is in the cathode guidance profiles. Next, the 14 cathodes were immersed one after the other, as shown in FIG. 4 and the 13 copper anodes. The vat was filled with copper sulphate electrolyte of a composition equivalent to that of the industrial plant simulated.

The electrolysis operation was initiated at a voltage of 2.6 volts between anode and cathode at a current density of 300 amperes per square meter and simultaneously a single direction electrical pulse was released through the conductors of the energizable cathode guidance profiles, this time connected in a series, with a power equivalent to 25 watts perimeter of cathode edge to be protected.

Upon completing the operation cycle, it was observed that the copper deposited on the lateral edges of the cathodes was negligible, and did not interfere with the removal of the metallic deposition, thus demonstrating the solution to the problem.

The advantages of the cathode guidance assembly and their associated operating procedure with respect to what is known in the matter today are as follows:

- Prevents the deposit of metal on the edges of the cathodes, something that does not happen in plastic excluder protection solutions. With respect to the use of metallic frames joined to the cathode with the application of radio frequency, it saves on the conditioning of such metallic frames and their replacement after a few cycles of operation.
- Because there is practically no metal deposition on the lateral edges of the cathode, it is easier to remove the metal deposited on both faces of the stainless steel cathode.
- Saves energy by avoiding a re-processing of the metal harvested when it is damaged upon removing it from the stainless steel cathode.
- It avoids the repair and replacement of damaged stainless steel cathodes.

It avoids the individual placement of excluders as in industrial practice, the set of initial stainless steel cathodes is loaded simultaneously in the cathode guidance Assembly and control of perimeter deposition in electro-metallurgy cathodes.

It avoids short-circuits between anodes and cathodes derived of their oscillation by maintaining in a fixed position the cathodes inserted into the energizable cathode guidance profiles 1, and the anodes fixed onto their lower horizontal side, because they are inserted into the anode supporting profiles 11. Thus, short-circuiting is limited preferably to the growth of depositions in some places and to the excessive accumulations of anodic clay on the bottom of the vat.

The invention claimed is:

1. Apparatus to control perimeter deposition on the edges of the cathodes in an electro-metallurgical bath comprising:

a plurality of cathode guidance profiles each having a generally channel shape with an elongated channel opening therein, energizable through electrical conductors inserted lengthwise along the profile, the channel-shaped cathode guidance profiles being arranged vertically in first and second horizontally spaced apart sets, with the profiles of each set being generally parallel to, and spaced from, each other, and the profile channel openings of each set facing in the same direction;

a supporting structure built of electrically insulating material, the first and second sets of profiles being mounted to said supporting structure with the profile channel opening of the sets facing each other and being spaced at a distance slightly less than the width of the cathodes and separated laterally from adjacent channels by substantially uniform spaces;

a plurality of cathodes each having a perimeter edge and each being positioned between a different opposed pair of profiles of the first and second profile sets, with their respective opposite vertical perimeter edge sections thereof projecting into the channel openings of the opposed profile pair; and a source of unidirectional electrical current connected to the electrical conductors of the profiles to facilitate electro-deposition onto the cathodes inhibiting deposition on the cathode perimeter edges when the cathodes and cathode guidance profiles are in an electro-metallurgical bath.

2. The apparatus of claim 1 wherein the electrical conductors inserted in the cathode guidance profiles include at least one conductor selected from the group of single thread and multiple thread conductors.

3. The apparatus of claim 1 further comprising a third set of spaced parallel channel-shaped cathode guidance profiles each having an elongated channel opening facing upwardly, the profiles of the third set arranged generally horizontally between the lower ends of the first and second sets of profiles, with the opposite ends of the different profiles being located between the lower ends of different pairs of profiles of the first and second profile sets, and wherein the bottom section of the perimeter edge of each cathode projecting into the channel opening of a different one of the profiles of said third set, whereby the cathodes are supported in spaced parallel vertical disposition relative to each other.

4. The apparatus of claim 1 wherein the cathode guidance profiles of said first and second sets are angled outwardly to space the upper ends of opposed pairs of guidance profiles of the first and second sets at a greater distance from each other than the spacing between their respective lower ends.

5. The apparatus of claim 1 wherein the source of electrical current includes an alternating current rectifier.

6. The apparatus of claim 1 wherein the electrically insulating material of the supporting structure electrically insulates the exterior of the support structure.

7. A method comprising the steps of:

providing the apparatus of claim 1;

locating said apparatus in a vat containing an electrolytic bath; and operating the apparatus in a manner selected from the group of metal production, treatment of liquid industrial residues, and galvanoplasty.

* * * * *